US008683771B2

(12) United States Patent
Sawyers et al.

(10) Patent No.: US 8,683,771 B2
(45) Date of Patent: Apr. 1, 2014

(54) ADJUSTABLE FRAME ASSEMBLY AND METHOD OF ASSEMBLING THE ADJUSTABLE FRAME ASSEMBLY

(75) Inventors: Jeffrey V. Sawyers, Rice Lake, WI (US); Joseph D. Isaacs, Cameron, WI (US); Scott Fetting, Rice Lake, WI (US); Brian Jensen, Cameron, WI (US); Joe Cutsforth, Rice Lake, WI (US)

(73) Assignee: Quanex Corporation, Houston, TX (US)

( * ) Notice: Subject to any disclaimer, the term of this patent is extended or adjusted under 35 U.S.C. 154(b) by 0 days.

(21) Appl. No.: 13/439,411

(22) Filed: Apr. 4, 2012

(65) Prior Publication Data

US 2012/0247056 A1 Oct. 4, 2012

Related U.S. Application Data

(60) Provisional application No. 61/471,476, filed on Apr. 4, 2011.

(51) Int. Cl.
*E04C 2/38* (2006.01)

(52) U.S. Cl.
USPC ..... 52/656.7; 52/656.9; 52/656.5; 52/222; 29/525.08

(58) Field of Classification Search
USPC ..... 52/656.1–656.9, 273, 222, 63; 29/525.08
See application file for complete search history.

(56) References Cited

U.S. PATENT DOCUMENTS 875,552 A 12/1907 McGee
1,171,950 A 2/1916 Haynes
1,201,338 A 10/1916 Orr
1,211,403 A 1/1917 Burrowes
1,235,735 A 8/1917 Steffan et al.
1,248,857 A 12/1917 Higgin
2,627,311 A 2/1953 Kaufmann
2,709,489 A 5/1955 Keebler
2,784,781 A 3/1957 Rhoades
2,840,161 A 6/1958 Alexander et al.
3,187,801 A 6/1965 Saling
3,220,469 A 11/1965 Oehmig
3,379,237 A 4/1968 Worthington
3,451,153 A * 6/1969 Dohanyos ..... 40/741
3,552,476 A 1/1971 Le Tarte (Continued)

OTHER PUBLICATIONS

Definition of clip found at: http://dictionary.reference.com/browse/clip?s=t&path=/.*

*Primary Examiner* — Brian Glessner
*Assistant Examiner* — Brian D Mattei
(74) *Attorney, Agent, or Firm* — Howard & Howard Attorneys PLLC

(57) ABSTRACT

A method of assembling an adjustable frame assembly for supporting a fenestration article includes the steps of sliding sections of each rail member along adjustment splices to adjust a width of the adjustable frame assembly and/or sliding sections of stile members along adjustment splices to adjust a height of the adjustable frame assembly. The fenestration article is disposed along a wall and at least partially within a groove of the rail member and stile member. A plurality of rail clips are inserted into the groove of each rail member to secure the fenestration article to each rail member. A plurality of stile clips are inserted into the groove of each stile member to secure the fenestration article to each stile member. The rail clips are disposed adjacent the stile clips to prevent adjustment of the width and/or height of the adjustable frame assembly resulting from compression forces.

24 Claims, 9 Drawing Sheets

(56) References Cited

U.S. PATENT DOCUMENTS

| | | | | |
|---|---|---|---|---|
| 4,194,312 | A | 3/1980 | Connors et al. | |
| 4,662,038 | A | 5/1987 | Walker | |
| 4,799,299 | A | 1/1989 | Campbell | |
| 5,039,246 | A | 8/1991 | Woodruff et al. | |
| 5,237,785 | A | 8/1993 | Lukes | |
| 5,380,120 | A | 1/1995 | Vermeulen | |
| 6,977,021 | B2 | 12/2005 | Annacchino | |
| 7,735,540 | B2 | 6/2010 | Armstrong | |
| 2001/0035268 | A1* | 11/2001 | Desrochers | 160/31 |
| 2004/0128894 | A1* | 7/2004 | Sachs-Lavery | 40/741 |
| 2004/0140067 | A1 | 7/2004 | Kelley et al. | |
| 2005/0056389 | A1 | 3/2005 | Kelley et al. | |
| 2007/0256800 | A1* | 11/2007 | Armstrong | 160/371 |
| 2010/0147471 | A1 | 6/2010 | Bull | |
| 2010/0206364 | A1 | 8/2010 | Armstrong | |

* cited by examiner

FIG. 2
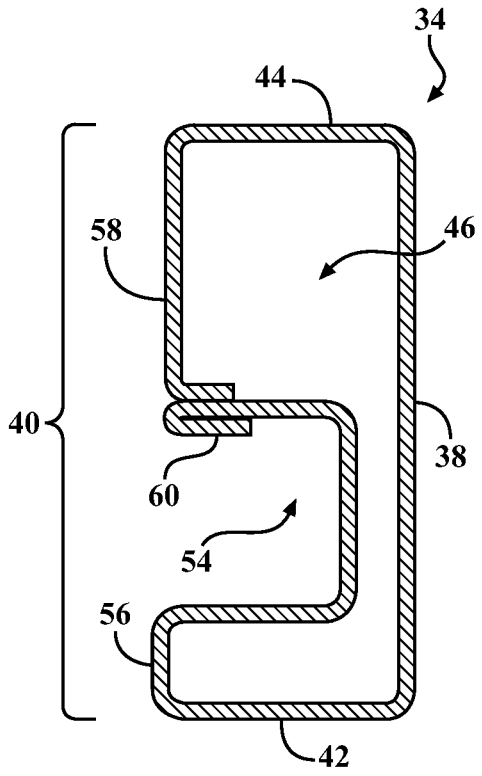
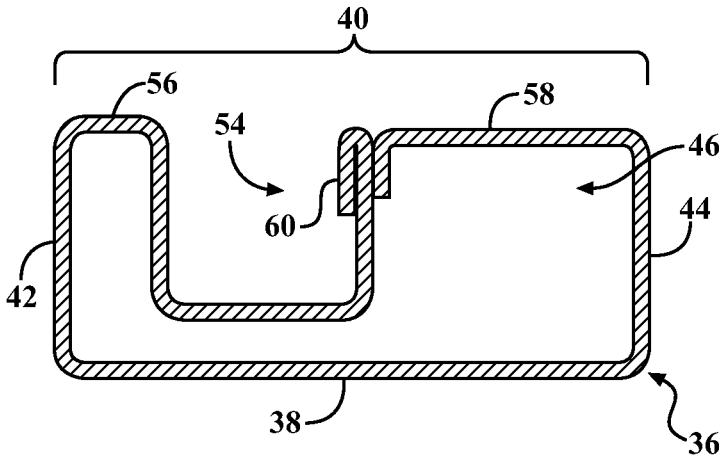
FIG. 3

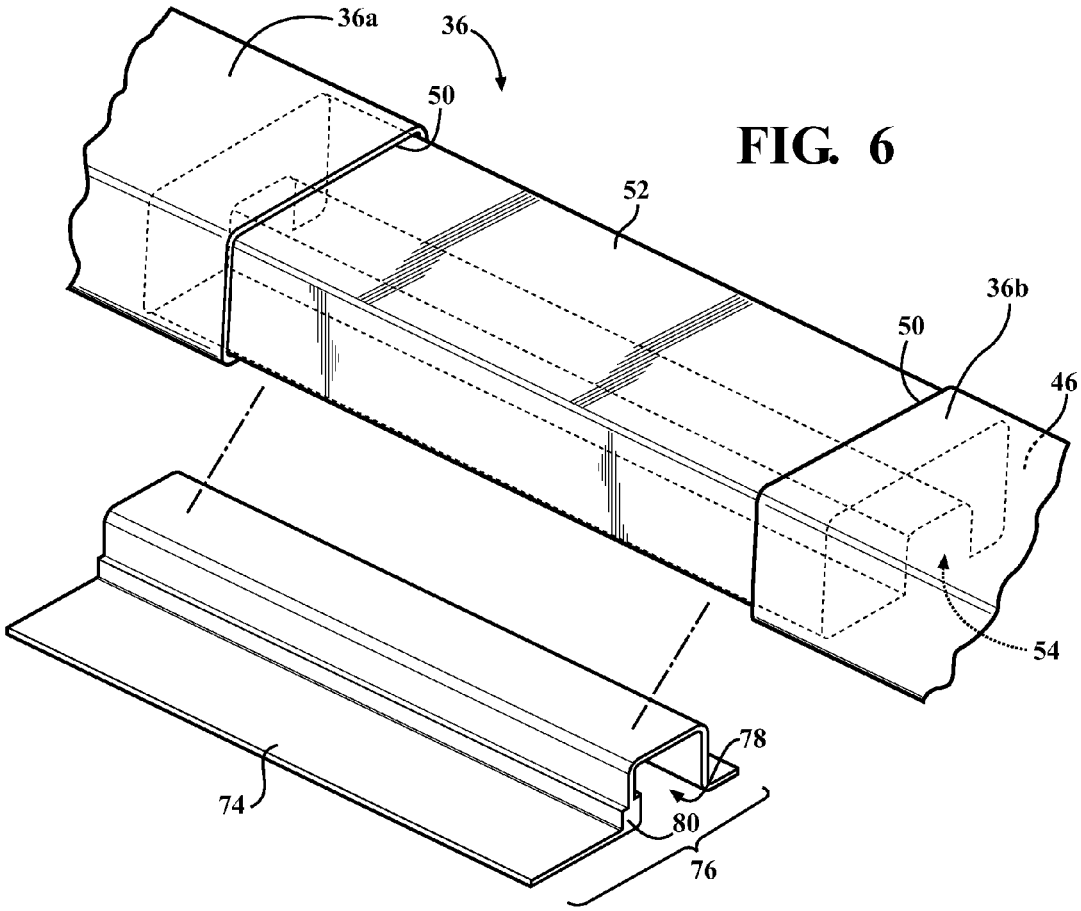
FIG. 6
FIG. 7
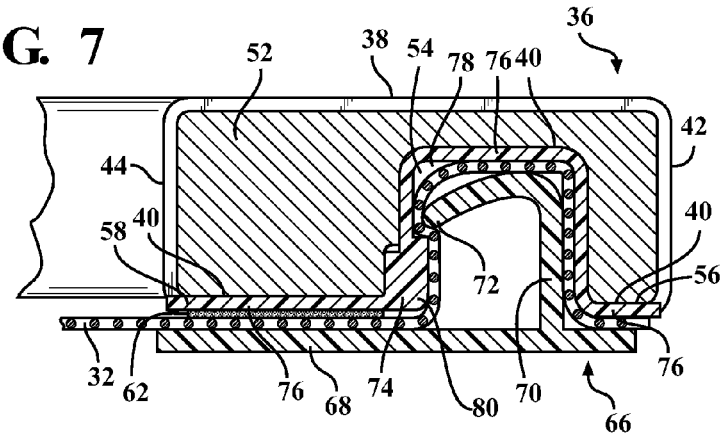

ADJUSTABLE FRAME ASSEMBLY AND METHOD OF ASSEMBLING THE ADJUSTABLE FRAME ASSEMBLY

CROSS-REFERENCE TO RELATED APPLICATIONS

The subject patent application claims priority to and all the benefits of U.S. Provisional Patent Application Ser. No. 61/471,476 which was filed on Apr. 4, 2011 the entire disclosure of which is expressly incorporated herein by reference.

BACKGROUND OF THE INVENTION

1. Field of the Invention

The invention generally relates to an adjustable frame assembly and, more specifically, to an adjustable frame assembly for supporting a fenestration article and a method of assembling the adjustable frame assembly.

2. Description of the Related Art

Frame assemblies that support fenestration articles, such as screen cloths, are widely used and are well known in the art. Typically, the frame assemblies are disposed within an opening, which is defined by a structure, such as a building or house, for covering the opening. Occasionally, the frame assemblies may need to be replaced for a variety of reasons. For example, the frame assemblies may be lost or damaged and must be replaced.

A conventional replacement frame assembly typically includes a pair of rail members and a pair of stile members which are coupled to form the conventional replacement frame assembly. Typically, in methods of providing the conventional replacement frame assembly, a generic kit is provided which includes uncut rail and stile members. Dimensions of the opening are measured and the rail and stile members are cut to size according to the dimensions of the opening measured. The rail and stile members are subsequently coupled together to form the replacement frame assembly. Cutting and constructing the replacement frame assembly is time consuming, labor intensive, and costly. Additionally, errors in measuring the dimensions of the opening or inaccurate cutting of the rail and stile members may result in the conventional replacement frame assembly not adequately coving the opening of the structure.

Alternatively, the conventional replacement frame assembly may be purchased from a store preassembled according to standard dimensions. However, given the various sizes of doors and windows available for installation in the structure, it is unlikely that the conventional replacement frame assemblies that are preassembled will be available for all the various sizes of doors and windows. As such, conventional replacement frame assemblies commonly must be custom ordered from a manufacturer with the manufacturer preassembling the conventional replacement frame assembly at custom dimensions according to the measured dimensions of the opening. However, the conventional replacement frame assembly that is custom ordered from the manufacturer is expensive. Additionally, the conventional replacement frame assembly that is custom ordered from the manufacturer may take several weeks to manufacture and deliver. Furthermore, the conventional replacement frame assembly that is custom ordered from the manufacturer cannot compensate for errors made while measuring the dimensions of the opening.

Additionally, the fenestration article may need to be replaced for several reasons. For instance, when the fenestration article is the screen cloth, the screen cloth may be damaged, worn out, aesthetically unappealing, or the like. Typically, methods of installing a conventional replacement screen cloth require the conventional replacement screen cloth to be aligned with a frame assembly, which may be the original frame assembly that was provided with the window or door. Once the conventional replacement screen cloth is aligned with the frame assembly, a rubber gasket is inserted into a channel, which is defined along the rail and stile members of the frame assembly, to force the conventional replacement screen cloth into the channel of the rail and stile members.

However, the typical method of installing the conventional replacement screen cloth is labor intensive, time consuming, and often difficult to execute properly by a single individual. Additionally, the rubber gasket can degrade over time leading to the conventional replacement screen cloth separating from the frame assembly, which is undesirable.

Accordingly, there remains a need to provide an improved frame assembly and an improved method of installing a fenestration article therein.

SUMMARY OF THE INVENTION AND ADVANTAGES

An adjustable frame assembly for supporting a fenestration article includes a pair of rail members spaced from each other and a pair of stile members spaced from each other. The pair of stile members are coupled to the pair of rail members. Each of the rail members and/or each of the stile members includes sections spaced from each other. At least one adjustment splice interconnects the sections of each rail member and/or each stile member. Each of the rail members and stile members includes a wall defining a groove. A plurality of rail clips are configured for insertion into the groove of each rail member. A plurality of stile clips are configured for insertion into the groove of each stile member.

A method of assembling the adjustable frame assembly includes the step of sliding the sections of each rail member along at least one of the adjustment splices to adjust a width of the adjustable frame assembly and/or sliding the sections of each stile member along at least one of the adjustment splices to adjust a height of the adjustable frame assembly. The method includes the step of disposing the fenestration article along the wall and at least partially within the groove of each rail member and each stile member. The method includes the step of inserting the plurality of rail clips into the groove of each rail member to secure the fenestration article between the rail clip and the wall of each rail member. The method includes the step of inserting the plurality of stile clips into the groove of each stile member to secure the fenestration article between the stile clip and the wall of each stile member. The method includes the step of disposing the plurality of rail clips adjacent the plurality of stile clips to prevent adjustment of the width and/or height of the adjustable frame assembly resulting from compression forces acting on the adjustable frame assembly.

The adjustable frame assembly and method advantageously provide simple assembly and adjustment of the width and/or height of the adjustable frame assembly thereby minimizing time and labor required to assemble the adjustable frame assembly. Furthermore, the adjustable frame assembly and method advantageously provide simple installation of the fenestration article to the adjustable frame assembly without requiring tools. Accordingly, time and labor required to install the fenestration article to the adjustable frame assembly is minimized.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a cross-sectional view of one of the rail members taken along line A1-A1 of FIG. 1;

FIG. 3 is a cross-sectional view of one of the stile members taken along line A2-A2 of FIG. 1;

FIG. 6 is a an enlarged assembly view of a portion of the adjustable frame assembly within B of FIG. 1;

FIG. 7 is a cross-sectional view of one of the stile members of the adjustable frame assembly including one of the adjustment splices disposed within an interior of the stile member and a splice filler disposed on the adjustment splice;

DETAILED DESCRIPTION OF THE INVENTION

Referring to the Figures, wherein like numerals indicate corresponding parts throughout the several views, an adjustable frame assembly is generally shown at 30. The adjustable frame assembly 30 supports a fenestration article 32. As illustrated generally throughout the Figures, the fenestration article 32 may be a screen cloth. However, the adjustable frame assembly 30 may support other fenestration articles 32, such as a glass panel, and the like. Specifically, the fenestration article 32 may be substantially transparent and configured to reflect ultraviolet light. The fenestration article 32 may also be decorative and include a symbol and/or decorative image formed thereon.

The adjustable frame assembly 30 is typically disposed within an opening which is defined by a structure, such as a building or house, for covering the opening. The adjustable frame assembly 30 may cover the opening while disposed on a door or window received by the opening. Alternatively, the adjustable frame assembly 30 may cover the opening while disposed on the structure itself. The adjustable frame assembly 30 may be used to replace lost or damaged frame assemblies. Furthermore, the adjustable frame assembly 30 may be originally supplied by a manufacturer of the adjustable frame assembly 30. The adjustable frame assembly 30 may be provided in a kit or with the door or window to be disposed in the structure.

Figure 1:
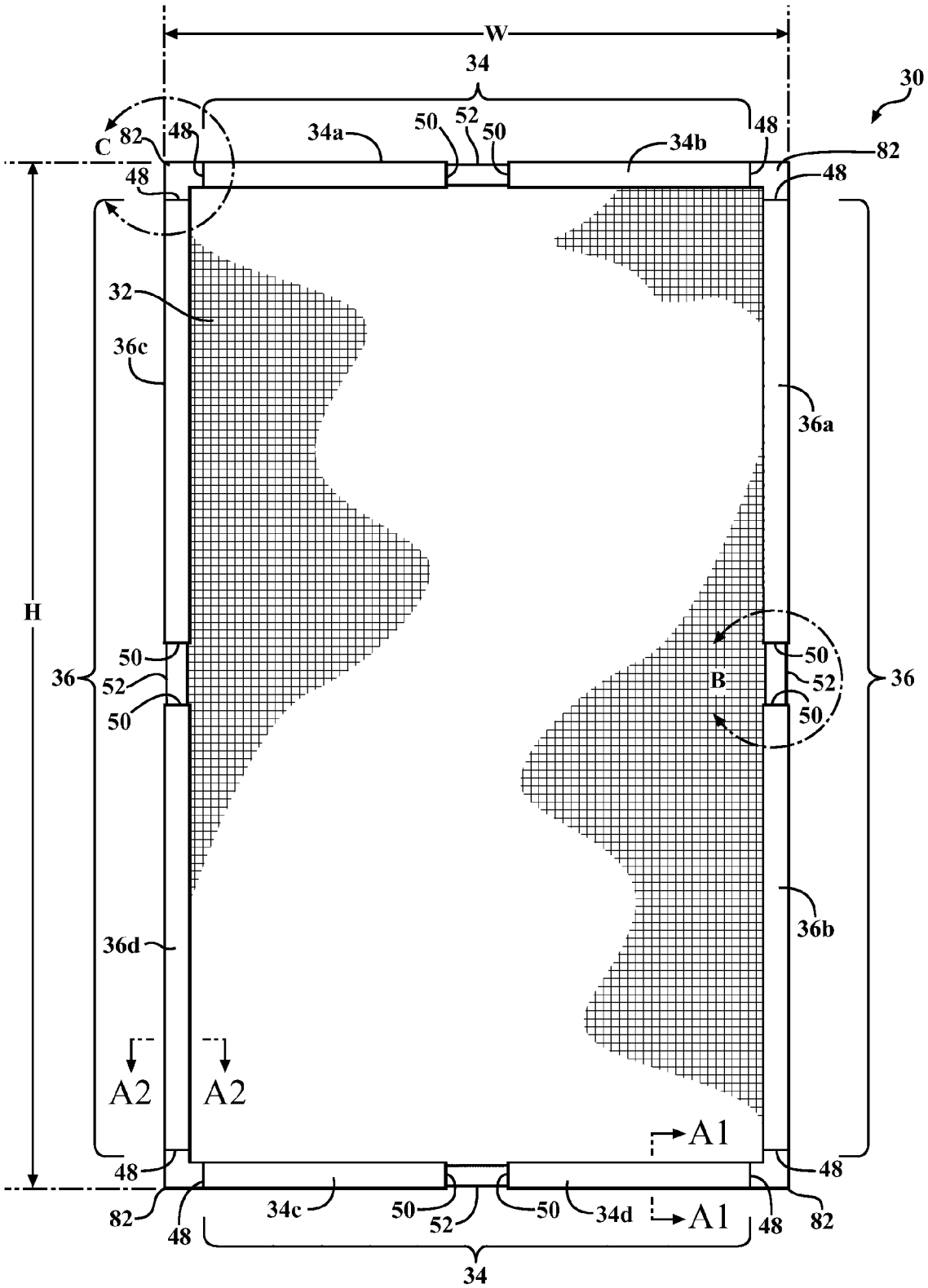
FIG. 1 is a front view of an adjustable frame assembly supporting a fenestration article and including a pair of rail members and a pair of stile members with each of the rail members and each of the stile members including sections spaced from each other and with at least one adjustment splice interconnecting sections of each of the rail members and each of the stile members.
Figure 4:
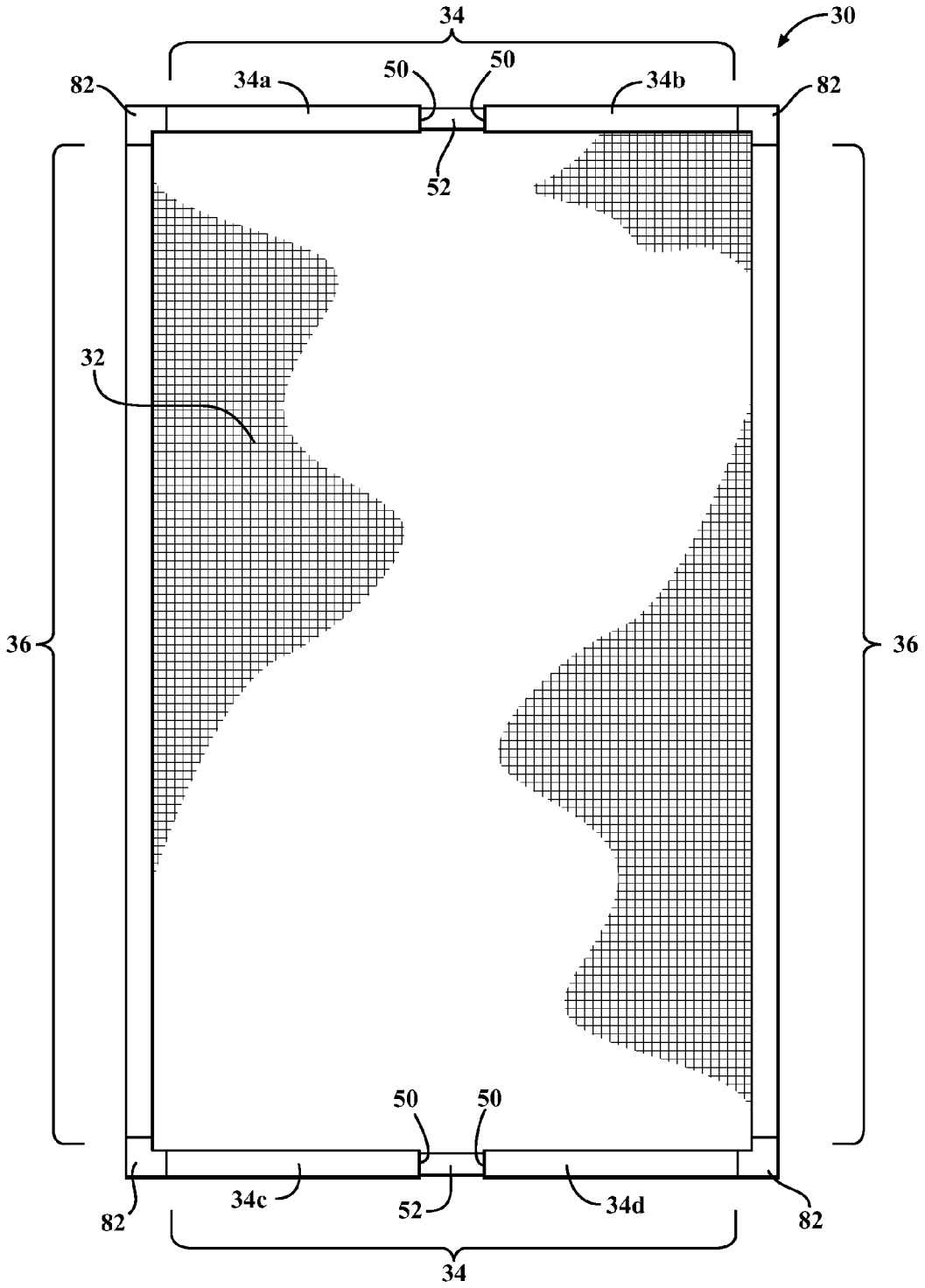
FIG. 4 is another front view of the adjustable frame assembly according to one embodiment whereby the adjustable frame assembly includes the pair of rail members which are adjustable and the pair of stile members which are fixed in length.
Figure 5:
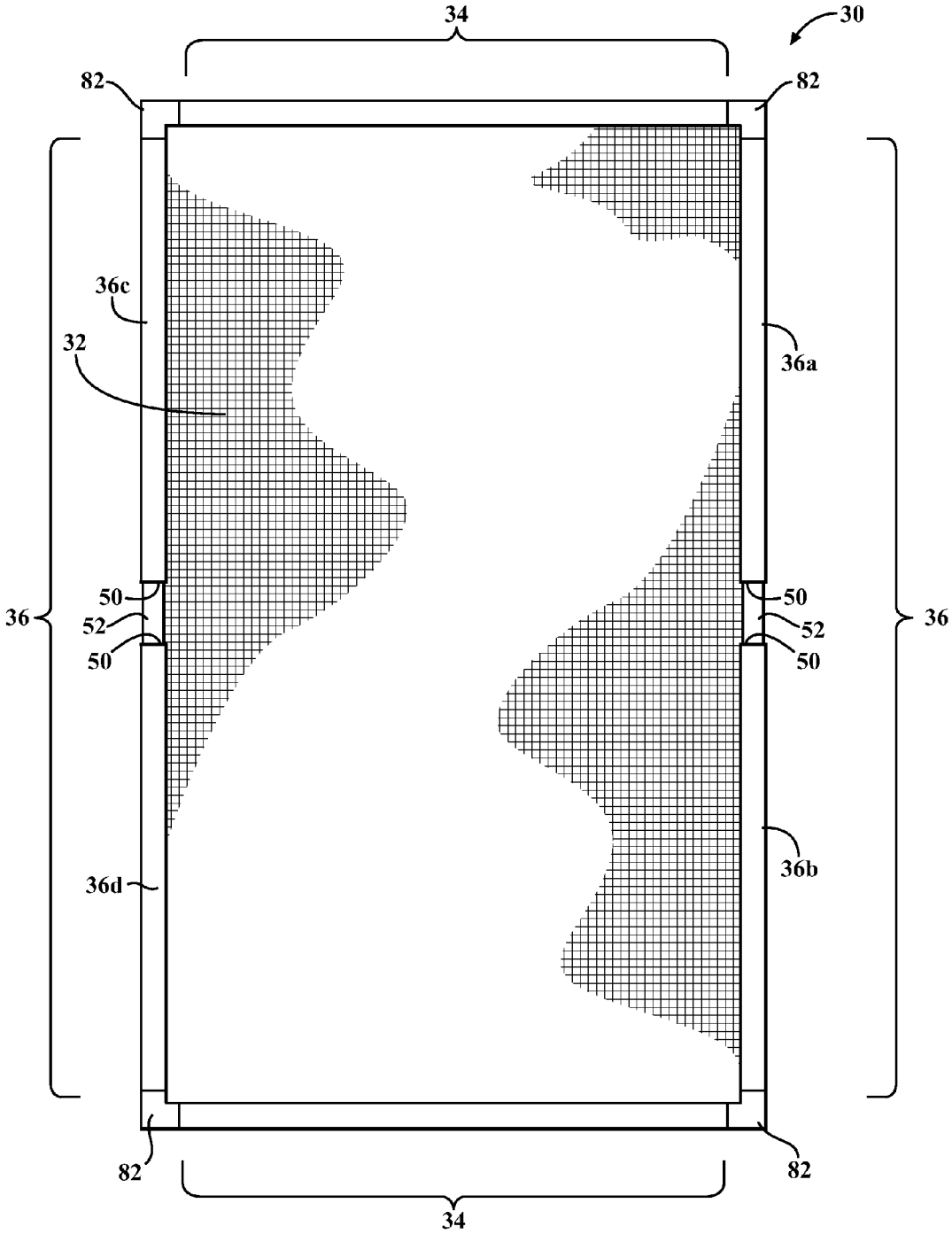
FIG. 5 is another front view of the adjustable frame assembly according to another embodiment whereby the adjustable frame assembly includes the pair of rail members which are fixed in length and the pair of stile members which are adjustable.

As shown in FIGS. 1, 4, and 5, the adjustable frame assembly 30 includes a pair of rail members 34 and a pair of stile members 36. Each of the rail members 34 are spaced from each other and each of the stile members 36 are spaced from each other. The pair of rail members 34 are coupled to the pair of stile members 36, and vice-versa. Typically, the rail members 34 are coupled substantially traverse to the stile members 36, and vice-versa, thereby presenting a rectangular configuration of the adjustable frame assembly 30. However, the adjustable frame assembly 30 may define any suitable quadrilateral configuration, including, but not limited to, a trapezoidal configuration, and the like. Conventionally, the pair of rail members 34 extend along a width W of the adjustable frame assembly 30 and the pair of stile members 36 extend along a height H of the adjustable frame assembly 30, as shown in FIG. 1.

The rail members 34 are often mirror images of each other and the stile members 36 are often mirror images of each other. As shown in FIGS. 2 and 3, respectively, the rail members 34 and the stile members 36 each have a cross-section. Typically, the cross-section of each of the rail members 34 is substantially similar to the cross-section of each of the stile members 36. As such, common features between the rail members 34 and the stile members 36 may be identified by common descriptive terms and indicated by the same reference numeral.

The rail members 34 and the stile members 36 each have an exterior wall 38 and an interior wall 40 opposite the exterior wall 38. Typically, the interior wall 40 of each of the rail members 34 and each of the stile members 36 faces an interior of the structure when the adjustable frame assembly 30 is disposed on the structure. The exterior wall 38 of each of the rail members 34 and each of the stile members 36 is visible from an exterior of the structure when the adjustable frame assembly 30 is disposed on the structure.

The rail members 34 and the stile members 36 each further include an outer wall 42 and an inner wall 44 opposite the outer wall 42. Both the outer wall 42 and the inner wall 44 are disposed between the interior wall 40 and the exterior wall 38. Generally, the outer walls 42 of the rail members 34 and stile members 34 define a periphery of the adjustable frame assembly 30. The exterior wall 38, the interior wall 40, the outer wall 42, and the inner wall 44 collectively define the cross-section of each of the rail members 34 and each of the stile members 36. Each of the rail members 34 and the stile members 36 each have an interior 46, which is typically hollow. The interior 46 of each of the rail members 34 and the stile members 36 may include filler, such as an insulating material and/or a stiffening material or component.

The rail members 34 and the stile members 36 may be formed together as a unitary member and subsequently divided to form the rail members 34 and the stile members 36. Said differently, the rail members 34 and the stile members 36 may be cut from a common piece of stock if the cross-sections of the rail members 34 and the stile members 36 are similar. Forming the rail members 34 and the stile members 36 from the common piece of stock minimizes the amount of time to manufacture the adjustable frame assembly 30 because the rail members 34 and the stile members 36 do not have to be formed independent of one another. The rail members 34 and the stile members 36 may be made from any suitable material, such as metal, plastic, or the like. Furthermore, the rail members 34 and the stile members 36 may be formed by any suitable process, such as molding, roll forming, extruding, and/or bending. Additionally, having the rail members 34 and the stile members 36 with similar cross-sections allows the rail members 34 and the stile members 36 to have cross-sections of irregular shapes, such as architectural sections as is known in the art.

As shown in FIG. 1, the rail members 34 and the stile members 36 each have outer ends 48. The outer ends 48 are open for allowing access to the interior 46 of the rail members 34 and the stile members 36. Typically, a length of each of the rail members 34 and a length of each of the stile members 36 is defined by a distance between outer ends 48 of each of the respective rail members 34 and stile members 36.

Each of the rail members 34 and/or each of the stile members 36 includes sections spaced from each other. For simplicity, sections of each of the rail members 34 are hereinafter refereed to as "rail sections 34*a*-34*d*" and sections of each of the stile members 36 are hereinafter referred to as "stile sections 36*a*-36*d*." The rail sections 34*a*-34*d* are similar to each other and the description below applies generally to all of the rail sections 34*a*-34*d*. Likewise, the stile sections 36*a*-36*d* are similar to each other and the description below applies generally to all of the stile sections 36*a*-36*d*. Thus, for simplicity, only rail sections 34*a* and 34*b* and stile sections 36*a* and 36*b* are described in detail below.

In one embodiment, as illustrated in FIG. 1, each of the rail members 34 includes rail sections 34*a*, 34*b* spaced from each other and each of the stile members 36 includes stile sections 36*a*, 36*b* spaced from each other. As such, each of the rail members 34 and each of the stile members 36 are adjustable for adjusting the width and/or height of the adjustable frame assembly 30, as will be described in greater detail below. In another embodiment, as illustrated in FIG. 4, only the rail members 34 include the rail sections 34*a*, 34*b* spaced from each other. Said differently, in this embodiment, the stile members 36 generally do not include the stile sections 36*a*, 36*b* and are fixed in length. Accordingly, each of the rail members 34 are adjustable for adjusting the width of the adjustable frame assembly 30. In yet another embodiment, as illustrated in FIG. 5, the rail members 34 do not include the rail sections 34*a*, 34*b* and only the stile members 36 include the stile sections 36*a*, 36*b* spaced from each other. Thus, the width of the adjustable frame assembly 30 is fixed and the stile members 36 are adjustable for adjusting the height of the adjustable frame assembly 30.

Each of the rail members 34 may include any suitable number of rail sections 34*a*, 34*b* and each of the stile members 36 may include any suitable number of stile sections 36*a*, 36*b*. A length of one of the rail sections, such as 34*a*, may be the same as or different than a length of another rail section, such as 34*b*, on any of the rail members 34. Similarly, a length of one of the stile sections, such as 36*a*, may be the same as or different than a length of another stile section, such as 36*b*, on any of the stile members 36. Furthermore, the length of one of the rail sections, e.g., 34*a*, may be the same as or different than the length of one of the stile sections, e.g. 36*a*, and vice-versa. Additionally, each of the rail sections 34*a*, 34*b* and stile sections 36*a*, 36*b* have an inner end 50, which is open for allowing access to the interior 46 of each of the respective rail members 34 or stile members 36. The inner end 50 is typically disposed opposite the outer end 48 of each of the respective rail members 34 and stile members 36. As such, the outer end 48 of each of the respective rail members 34 and stile members 36 may correspond to the outer end 48 of one of the rail sections 34*a*, 34*b*, and/or one of the stile sections 36*a*, 36*b*.

As illustrated generally throughout the Figures, the adjustable frame assembly 30 includes at least one adjustment splice 52. One of the adjustment splices 52 interconnects the rail sections 34*a*, 34*b* of each of the rail members 34. The adjustment splice 52 couples together the rail sections 34*a*, 34*b* to form one of the rail members 34. In particular, the adjustment splice 52 is disposed within the interior 46 of one of the rail members 34 at the inner end 50 of each of the rail sections 34*a*, 34*b*.

One of the adjustment splices 52 interconnects the stile sections 36*a*, 36*b* of each of the stile members 36. The adjustment splice 52 couples together the stile sections 36*a*, 36*b* to form one of the stile members 36. Specifically, as shown in FIG. 6, the adjustment splice 52 is disposed within the interior 46 of one of the stile members 36 at the inner end 50 of each of the stile sections 36*a*, 36*b*. More than one adjustment splice 52 may interconnect the rail sections 34*a*, 34*b* for each of the respective rail members 34 and/or the stile sections 36*a*, 36*b* for each of the respective stile members 36.

As illustrated in FIG. 7, the adjustment splices 52 each have a cross-section generally complimentary to the cross-section of the rail sections 34*a*, 34*b* and/or the stile sections 36*a*, 36*b*. In particular, the adjustment splices 52 are adapted to slidably engage the exterior wall 38, the interior wall 40, the outer wall 42, and the inner wall 44 of each of the rail sections 34*a*, 34*b* and each of the stile sections 36*a*, 36*b*. The adjustment splices 52 may have any suitable length, and be made of any suitable material, such as plastic or aluminum, to facilitate adjustments to the adjustable frame assembly 30. The adjustment splices 52 may also be colored or textured in any suitable way, including, but not limited to, matching the color and texture of the rail members 34 and the stile members 36 for aesthetic purposes.

The rail sections 34*a*, 34*b* and the stile sections 36*a*, 36*b* are adapted to slide and/or reciprocate freely along the adjustment splices 52. Said differently, the rail sections 34*a*, 34*b* and the stile sections 36*a*, 36*b* may be moveable with respect to each other along at least one of the adjustment splices 52. Specifically, the rail sections 34*a*, 34*b* may be slidable along the adjustment splice 52 to adjust the length of the rail member 34. As such, variable adjustment of the length of the rail members 34 generally results in variable adjustment of the width of the adjustable frame assembly 30, as desired. Similarly, the stile sections 36*a*, 36*b* may be slidable along the adjustment splice 52 to adjust the length of the stile member 36. Similarly, variable adjustment of the length of the stile members 36 generally results in variable adjustment of the height of the adjustable frame assembly 30, as desired.

A method of assembling the adjustable frame assembly 30 includes the step of sliding the rail sections 34*a*, 34*b* of each rail member 34 along at least one of the adjustment splices 52 to adjust the width of the adjustable frame assembly 30. Similarly, the method includes the step of sliding the stile sections 36*a*, 36*b* of each stile member 36 along at least one of the adjustment splices 52 to adjust the height of the adjustable frame assembly 30. The steps of sliding the rail sections 34*a*, 34*b* of each rail member 34 and/or sliding the stile sections 36*a*, 36*b* of each stile member 36 may be further defined as sliding the rail sections 34*a*, 34*b* of each rail member 34 along at least one of the adjustment splices 52 to adjust the width of the adjustable frame assembly and sliding the stile sections 36*a*, 36*b* of each stile member 36 along at least one of the adjustment splices 52 to adjust the height of the adjustable frame assembly. Sliding of the rail sections 34*a*, 34*b* of each rail member 34 may occur simultaneously or independently with the sliding of the stile sections 36*a*, 36*b* of each stile member 36.

Having the length of each respective rail member 34 and each respective stile member 36 of the adjustable frame assembly 30 be adjustable as desired is advantageous for both replacement frame assemblies as well as new frame assemblies. Specifically, when installing the adjustable frame assembly 30 of the present invention as a replacement, the dimension of the opening need not be precisely measured. In other words, the adjustable frame assembly 30 may be simply placed within the opening and adjusted to the dimensions of the opening. As such, the present invention is easy to install and control and avoids errors which may be made when manually measuring dimensions of the opening.

Figure 9:
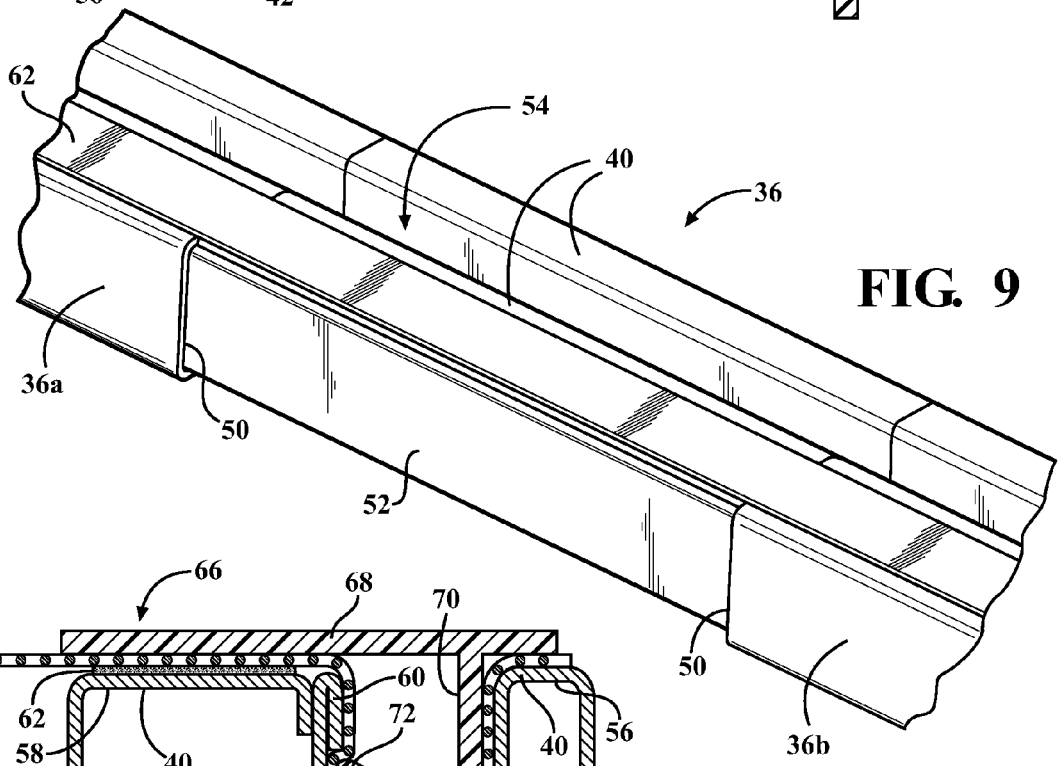
FIG. 9 is a perspective view of the portion of the adjustable frame assembly within B of FIG. 1 as taken from an underside view of FIG. 6, whereby the adhesive is applied to an interior wall of the stile member and one of the adjustment splices.

As shown generally in FIG. 9, each of the rail members 34 and each of the stile members 36 includes a wall defining a groove 54. Preferably, the wall is the interior wall 40 of the rail members 34 and/or the stile members 36. As such, for simplicity, the wall is hereinafter referenced according to the same numeral as the interior wall 40 and shown generally as the interior wall 40 throughout the Figures. However, the wall 40 may also be the exterior wall 38 of the rail members 34 and/or the stile members 36. The wall 40 of each of the rail members 34 and stile members 36 defines the groove 54 between a first flange 56 and a second flange 58. As such, the cross-section of each of the rail members 34 and stile members 36 has a general U-shaped configuration. However, the cross-section of each of the rail members 34 and stile members 36 is not limited to the U-shaped configuration and may be any suitable configuration in accordance with the present invention.

The wall 40 of each of the rail members 34 defines a projection 60 extending into the groove 54 from the wall 40 of each of the rail members 34. Similarly, the wall 40 of each of the stile members 36 defines the projection 60 extending into the groove 54 from the wall 40 of each of the stile members 36. The projection 60 may be integral with the wall 40, or alternatively, the projection 60 may be a discrete component relative to the wall 40 of each of the rail members 34 and stile members 36.

Figure 8:
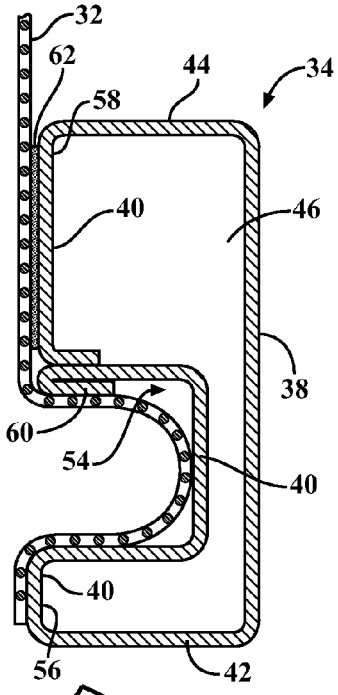
FIG. 8 is a cross-sectional view of one of the stile members of the adjustable frame assembly showing the stile member having an adhesive applied thereon and the fenestration article applied to the adhesive.

The method includes the step of disposing the fenestration article 32 along the wall 40 and at least partially within the groove 54 of each rail member 34 and each stile member 36. Said differently, the fenestration article 32 may be disposed along the wall 40 and at least partially within the groove 54 of at least one of the rail members 34 and/or the stile members 36. Furthermore, the fenestration article 32 may be disposed along the wall 40 of the rail member 34 and the stile member 36 and at least partially within the groove 54 of the rail member 34 and the stile member 36. The fenestration article 32 is preferably disposed along the interior wall 40 of the rail member 34 and/or the stile member 36. The fenestration article 32 may enter the groove 54 defined by the wall 40, as shown in FIG. 8. During assembly, the fenestration article 32 may be disposed over the adjustable frame assembly 30 thereby completely covering the adjustable frame assembly 30.

As illustrated in FIGS. 7-10, the adjustable frame assembly 30 may include an adhesive 62 disposed along the wall 40 of each of the rail members and/or stile members 36. Preferably, the adhesive 62 is applied upon the interior wall 40 of the rail members 34 and/or stile members 36. The method includes the step of applying the fenestration article 32 to the adhesive 62. The adhesive 62 adheres the fenestration article 32 to the rail members 34 and/or stile members 36. As such, the adhesive 62 secures the fenestration article 32 to the adjustable frame assembly 30 when pressure is applied to the fenestration article 32 against the adjustable frame assembly 30. Furthermore, the adhesive 62 and the fenestration article 32 may provide preliminary support to the adjustable frame assembly 30 by holding the rail members 34 and the stile members 36 together. Furthermore, the adhesive 62 and the fenestration article 32 may preliminarily set the length of the rail members 34 and the stile members 36 after adjustments are made. The adhesive 62 may be applied to the adjustment splices 52 and allowed to cure to prevent the rail sections 34*a*, 34*b* and/or the stile sections 36*a*, 36*b* from moving relative to the respective adjustment splices 52. The adhesive 62 may be of any suitable type, such as double-sided tape, or the like. Additionally, the adhesive 62 is preferably applied such that the adhesive spans the lengths of the rail members 34 and stile members 36. However, the adhesive 62 may be applied in any suitable manner or amount to the adjustable frame assembly 30. As will be described below, the adhesive 62 enables easy installation of the fenestration article 32 to the adjustable frame assembly 30.

Figure 11:
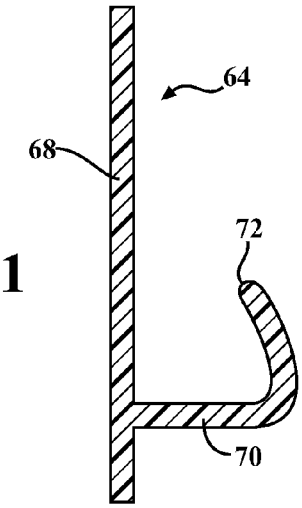
FIG. 11 is a cross-sectional view of a rail clip of the adjustable frame assembly.
Figure 10:
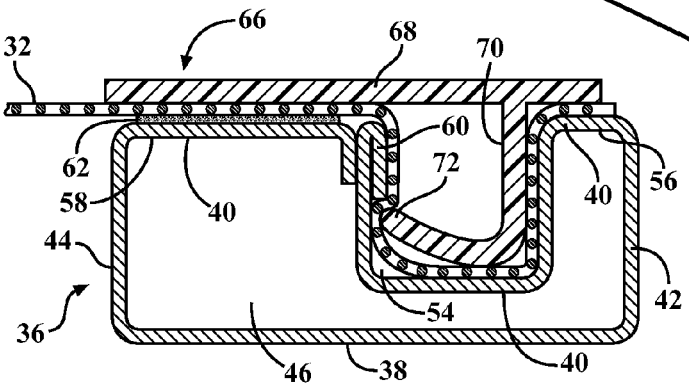
FIG. 10 is a cross-sectional view of one of the stile members of the adjustable frame assembly illustrating a stile clip inserted into the stile member with the fenestration article disposed between the stile member and the stile clip.

The adjustable frame assembly 30 further includes a plurality of rail clips 64 configured for insertion into the groove 54 of each of the rail members 34 and a plurality of stile clips 66 configured for insertion into the groove 54 of each of the stile members 36. The rail clips 64 and the stile clips 66 may be substantially similar, and therefore, only one of the rail clips 64 or stile clips 66 may be shown in particular Figures, for simplicity. As shown in FIG. 11, each of the rail clips 64 and stile clips 66 includes a back wall 68 having a substantially planar configuration. The rail clips 64 are configured for insertion into the groove 54 of each of the rail members 34 to secure the fenestration article 32 to the rail members 34. As illustrated in FIG. 10, the stile clips 66 are configured for insertion into the groove 54 of each of the stile members 36 to secure the fenestration article 32 to the stile members 36. The back wall 68 of each of the rail clips 64 and each of the stile clips 66 extends along the first flange 56 and the second flange 58 of the wall 40 of each of the respective rail members 34 and stile members 36. Each of the rail clips 64 and stile clips 66 includes a leg 70 which extends integrally from and substantially perpendicular to the back wall 68 and has a substantially planar configuration. A lip 72 extends integrally from the leg 70 in a direction towards the back wall 68 and has curved configuration. Accordingly, the back wall 68, the leg 70, and the lip 72 generally present a J-shaped cross-section for each of the rail clips 64 and the stile clips 66.

The rail clips 64 and/or the stile clips 66 may be colored or textured in any suitable way, including, but not limited to, matching the color and texture of each of the rail members 34 and stile members 36. The rail clips 64 and the stile clips 66 are preferably the same color as the respective rail members 34 and stile members 36 to provide the adjustable frame assembly 30 with an aesthetically appealing appearance. Furthermore, the rail clips 64 and/or the stile clips 66 may be comprised of any suitable material, for example, plastic, metal, or the like.

The method includes the step of inserting the plurality of rail clips 64 into the groove 54 of each rail member 34 to secure the fenestration article 32 between the rail clip 64 and the wall 40 of each rail member 34. The method also includes the step of inserting the plurality of stile clips 66 into the groove 54 of each stile member 36 to secure the fenestration article 32 between the stile clip 66 and the wall 40 of each stile member 36.

As shown in FIG. 10, as the rail clip 64 and/or the stile clip 66 is inserted into the groove 54, the lip 72 of the rail clip 64 and/or stile clip 66 engages the projection 60 with the fenestration article 32 disposed between the lip 72 and the projection 60. Accordingly, the method may include the step of disposing the fenestration article 32 between the projection 60 of the interior wall 40 of the rail member 34 and the lip 72 of the rail clip 64 for securing the fenestration article 32 to one of the rail members 34. Similarly, the method may include the step of disposing the fenestration article 32 between the projection 60 of the interior wall 40 of the stile member 36 and the lip 72 of the stile clip 66 for securing the fenestration article 32 to one of the stile members 36.

The fenestration article 32 may be in contact with the adhesive 62 and disposed between the adhesive 62 and the back wall 68 of the rail clip 64 and/or the stile clip 66. As such, the method may further include the step of securing the fenestration article 32 between the adhesive 62 and the back wall 68 of the rail clip 64 and/or the stile clip 66. Once the fenestration article 32 has been adhered to the adjustable frame assembly 30 and secured to the adjustable frame assembly 30 after insertion of the rail clips 64 and/or stile clips 66, the fenestration article 32 may have material extending beyond the outer wall 42 of the adjustable frame assembly 30 which may be trimmed.

Figure 13:
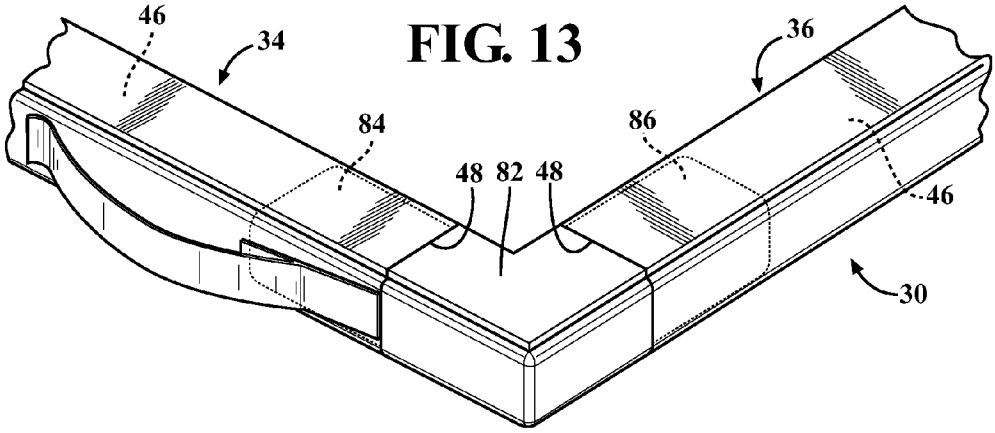
FIG. 13 is a perspective view of a corner member of the adjustable frame assembly of FIG. 1, within C of FIG. 1, showing the corner member disposed within one of the rail members and one of the stile members.

The rail clips 64 and the stile clips 66 have a length defined generally by the back wall 68 of each of the rail clips 64 and the stile clips 66. In one embodiment, as shown in FIG. 13, the length of each rail clip 64 and stile clip 66 substantially spans the length of one of the respective rail members 34 and stile members 36. Said differently, the length of each of the rail clips 64 and stile clips 66 is approximately equal to the distance between outer ends 48 of each of the respective rail members 34 and stile members 36. The method may include the step of sizing the length of each of the rail clips 64 and the stile clips 66 to substantially the same length of each of the respective rail members 34 and stile members 36. In such instances, one rail clip 64 is typically inserted into each respective rail member 34 and one stile clip 66 is typically inserted into each respective stile member 36. Alternately, the length of each of the rail clips 64 and the stile clips 66 may extend across a portion of the respective rail member 34 or stile member 36. In such instances, several rail clips 64 and stile clips 66 may be inserted into each respective rail member 34 and stile member 36.

Figure 12:
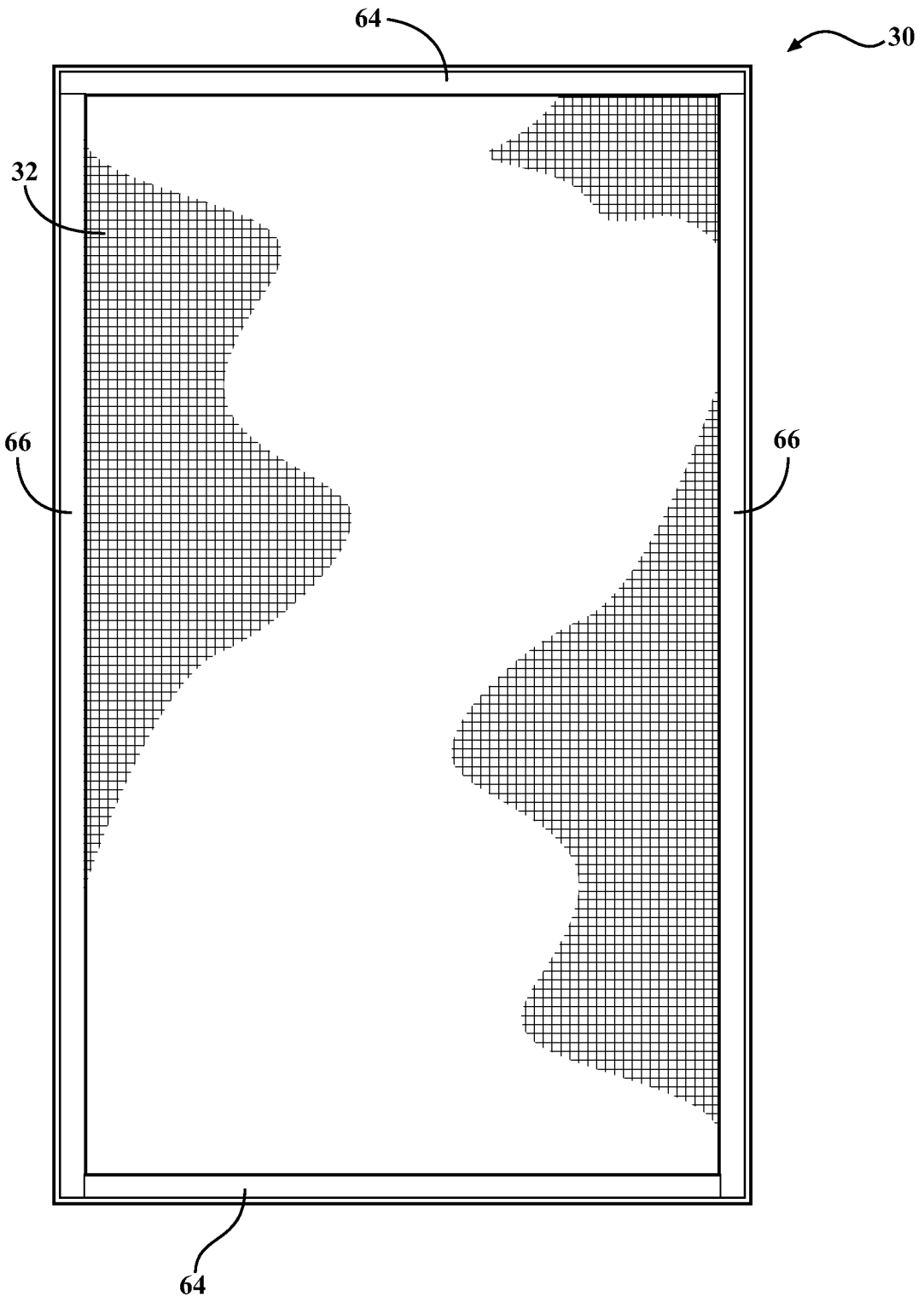
FIG. 12 is a rear view of the adjustable frame assembly according to one embodiment whereby the adjustable frame assembly includes a pair of rail clips and a pair of stile clips disposed adjacent one another.

The method includes the step of disposing the plurality of rail clips 64 adjacent the plurality of stile clips 66 to prevent adjustment of the width and/or height of the adjustable frame assembly 30 resulting from compression forces acting on the adjustable frame assembly 30. As mentioned above, the plurality of rail clips 64 are inserted into the walls 40 of the rail members 34 and the plurality of stile clips 66 are inserted into the walls 40 of the stile members 36. As illustrated in FIG. 12, after the rail clips 64 and stile clips 66 are inserted, the rail clips 64 and the stile clips 66 are disposed adjacent to one another because the rail clips 64 and the stile clips 66 are sized generally to span the length of the rail members 34 and the stile members 36. Accordingly, the plurality of rail clips 64 and the plurality of stile clips 66 provide structural stability to the adjustable frame assembly 30. The step of disposing the plurality of rail clips 64 adjacent the plurality of stile clips 66 may occur simultaneously with the steps of inserting the plurality of rail clips 64 into the groove 54 of each rail member 34 and inserting the plurality of stile clips 66 into the groove 54 of each stile member 36.

The step of disposing the plurality of rail clips 64 adjacent the plurality of stile clips 66 may be further defined as abutting together the plurality of rail clips 64 and the plurality of stile clips 66 to prevent adjustment of the width and/or height of the adjustable frame assembly 30 resulting from compression forces acting on the adjustable frame assembly 30. The step may be further defined as abutting together the back walls 68 of the plurality of rail clips 64 and the back walls 68 of the plurality of stile clips 66. Specifically, the back walls 68 of some of the rail clips 64 may abut the back walls 68 of other rail clips 64. Similarly, the back walls 68 of some of the stile clips 66 may abut the back walls 68 of other stile clips 66. Typically, the rail clips 64 abut one another along at least one of the rail members 34 and the stile clips 66 abut one another along at least one of the stile members 36. Simultaneously, the back walls 68 of some of the rail clips 64 may abut the back walls 68 of some of the stile clips 66, and vice-versa. The rail clips 64 abut the stile clips 66 typically near corners of the adjustable frame assembly 30. As the rail clips 64 and the stile clips 66 abut, the rail clips 64 may overlap the stile clips 66, and vice-versa. In one embodiment, as shown in FIG. 12, the adjustable frame assembly 30 may include a pair of stile clips 66 and a pair of rail clips 64 and the step of abutting together the plurality of rail clips 64 and the plurality of stile clips 66 may be further defined as abutting each rail clip 64 between the pair of stile clips 66 and each stile clip 66 between the pair of rail clips 64.

The adhesive 62, the plurality of rail clips 64, and the plurality of stile clips 66 provide significant advantages over the labor intensive, time consuming, and often difficult to execute conventional method of installing known fenestration articles 32 on known frame assemblies. Specifically, the adhesive 62, the plurality of rail clips 64, and the plurality of stile clips 66 allow a quicker and easier installation of the fenestration article 32 to the adjustable frame assembly 30 such that a single user inexperienced with conventional methods of installing known fenestration articles 32 can easily and quickly install the fenestration article 32 to the adjustable frame assembly 30 of the present invention.

As shown in FIGS. 6 and 7, the adjustable frame assembly 30 may include a plurality of splice fillers 74 each configured to be disposed on at least one of the adjustment splices 52 of the rail member 34 and/or the stile member 36. The splice filler 74 generally has a configuration substantially similar to the interior wall 40 of the rail members 34 and stile members 36. As such, common features between the splice fillers 74 and the rail members 34 and the stile members 36 may be identified by the same descriptive terms.

Each splice filler 74 includes a wall 76 defining a groove 78. The wall 76 of each splice filler 74 defines a projection 80 extending into the groove 78 from the wall 76 of each splice filler 74. The splice filler 74 may be substantially planar with the interior wall 40 of the rail sections 34*a*, 34*b* and/or stile sections 36*a*, 36*b* after being disposed on the respective adjustment splice 52. The groove 78 of the splice filler 74 typically faces the interior of the structure and adjoins the groove 54 of respective rail sections 34*a*, 34*b* or respective stile sections 36*a*, 36*b*. The splice fillers 74 are preferably the same color as the respective rail member 34 and stile member 36 to provide the adjustable frame assembly 30 with an aesthetically appealing appearance.

After adjustments are made to the rail members 34 and/or stile members 36, the adjustment splices 52 in the rail members 34 and/or stile members 36 may remain partially exposed between a gap defined between the inner end 50 of each of the rail sections 34*a*, 34*b* and/or each of the stile sections 36*a*, 36*b*. In such situations, the splice filler 74 may be disposed on the adjustment splices 52, as shown in FIG. 6.

The method may include the step of disposing one of the splice fillers 74 on at least one adjustment splice 52 between the rail sections 34*a*, 34*b* of each of the rail members 34 for filling the gap defined between the rail sections 34*a*, 34*b* after adjustment of the width of the adjustable frame assembly 30. Similarly, the method may include the step of disposing one of the splice fillers 74 on at least one adjustment splice 52 between the stile sections 36*a*, 36*b* of each of the stile members 36 for filling the gap defined between the stile sections 36*a*, 36*b* after adjustment of the height of the adjustable frame assembly 30. In some instances, the splice filler 74 may not be necessary because the adjustment splice 52 may be entirely concealed within the rail sections 34*a*, 34*b* or the stile sections 36*a*, 36*b* after adjustment of the adjustable frame assembly 30.

The method may include the step of sizing one of the splice fillers 74 to correspond the length of the gap defined substantially between inner end 50 of each rail section 34*a*, 34*b* after adjustment of the width of the adjustable frame assembly 30. Similarly, the method may include the step of sizing one of the splice fillers 74 to correspond to the length of the gap defined substantially between inner end 50 of each stile section 36*a*, 36*b* after adjustment of the height of the adjustable frame assembly 30. As such, as shown in FIG. 6, the splice filler 74 substantially occupies the gap defined between the rail sections 34*a*, 34*b* and/or stile sections 36*a*, 36*b* along the respective adjustment splice 52. The splice filler 74 may provide markings to assist with the sizing of the splice filler 74. Furthermore, the splice filler 74 may have a plurality of perforations for allowing sizing of the splice filler 74 without requiring tools for sizing of the splice filler 74.

As mentioned above, the fenestration article 32 is disposed along the wall 40 and at least partially within the groove 54 of the rail member 34 and/or stile member 36. The method may further include the step of inserting one of the rail clips 64 and/or stile clips 66 into the groove 78 of one of the splice fillers 74 to secure the fenestration article 32 between the rail clip 64 and/or stile clip 66 and the wall 76 of the splice filler 74. In so doing, the rail clip 64 and/or stile clip 66 mechanically engages the wall 76 of the splice filler 74, as shown in FIG. 7. More specifically, the method may include the step of disposing the fenestration article 32 between the projection 80 of the interior wall 76 of one of the splice fillers 74 and the lip 72 of one of the rail clips 64 and stile clips 66 to secure the fenestration article 32 to one of the splice fillers 74.

As illustrated in FIG. 7, the adhesive 62 may also be applied upon the splice filler 74. The adhesive 62 may secure the splice filler 74 to the respective rail member 34 and/or stile member 36. Furthermore, the adhesive 62 may adhere the fenestration article 32 to the splice filler 74 when pressure is applied to the fenestration article 32 against the splice filler 74. As such, the adhesive 62 secures the fenestration article 32 to the splice filler 74 and consequently to the respective rail member 34 and/or stile member 36.

Furthermore, as mentioned above, the plurality of rail clips 64 and the plurality of stile clips 66 are disposed adjacent one another to prevent adjustment of the width and/or height of the adjustable frame assembly 30. The method may further include step of abutting together the splice fillers 64 with the rail sections 34*a*, 34*b* of each of the rail members 34 and/or the stile sections 36*a*, 36*b* of each of the stile members 36 to prevent adjustment of the width and/or height of the adjustable frame assembly 30 resulting from compression forces acting on the adjustable frame assembly 30. Preferably, the wall 76 of each splice filler 74 abuts the walls 40 at the inner ends 50 of the rail sections 34*a*, 34*b* or the walls 40 at the inner ends 50 of stile sections 36*a*, 36*b*. As such, the splice fillers 74 prevent the length of the rail member 34 and/or the stile member 36 to be altered when subjected to compression forces.

As shown generally throughout the Figures, the adjustable frame assembly 30 may include corner members 82 for interconnecting one of the rail members 34 and one of the stile members 36. As illustrated in FIG. 13, each of the corner members 82 is slidably disposed between one of the rail members 34 and one of the stile members 36. The method includes step of inserting the corner members 82 into the pair of rail members 34 and the pair of stile members 36 to interconnect the pair of rail members 34 to the pair of stile members 36. As shown in FIGS. 1, 4, and 5, the adjustable frame assembly 30 preferably includes four corner members 82. The corner members 82 hold the rail members 34 and the stile members 36 together thereby providing further stability to the adjustable frame assembly 30.

The corner members 82 are typically identical in configuration and function. As such, for simplicity, only one of the plurality of corner members 82 may be described below and hereinafter referred to as "the corner member 82." Furthermore, the corner member 82 generally has a configuration similar to the interior wall 40 of the rail members 34 and stile members 36. As such, common features between the corner member 82 and the rail members 34 and the stile members 36 may be identified by the same descriptive terms.

Figure 14:
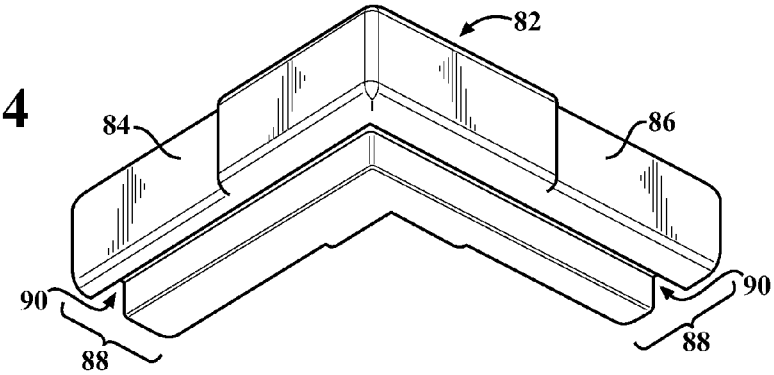
FIG. 14 is a perspective view of the corner member as taken from an underside view of FIG. 13, showing the corner member removed from the rail member and stile member.
Figure 15:
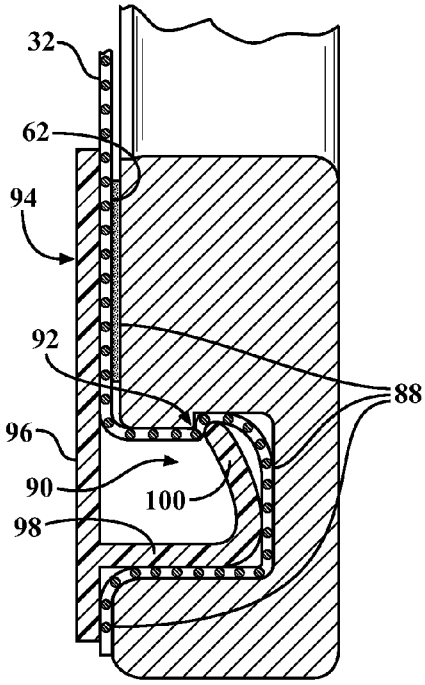
FIG. 15 is a cross-sectional view of the corner member showing a corner clip inserted into the corner member with the fenestration article disposed between the corner member and the corner clip.

As shown in FIGS. 13 and 14, the corner member 82 has a first arm 84 and a second arm 86. Typically, the first arm 84 extends into the interior 46 of the rail member 34 and the second arm 86 extends into the interior 46 of the stile member 36. As such, the outer ends 48 of the rail member 34 and the stile member 36 are typically located adjacent to the corner member 82. In FIGS. 14 and 15, the corner member 82 includes a wall 88 defining a groove 90 and a projection 92 extending into the groove 90 from the wall 88 of the corner member 82. The groove 90 of the corner member typically faces the interior of the structure and adjoins the groove 54 of one of the rail members 34 with the groove 54 of one of the stile members 36.

The method includes the step of inserting one of the rail clips 64 and/or stile clips 66 into the groove 90 of one of the corner members 82 to secure the fenestration article 32 between the rail clip 64 and/or stile clip 66 and the wall 88 of the corner member 82. Specifically, the fenestration article 32 may be disposed on the wall 88 of the corner member 82 and at least partially within the groove 90 of the corner member 82. As shown in FIG. 12, the rail clip 64 and/or stile clip 66 may extend along the respective rail member 34 and/or stile member 36 and overlap the corner member 82. As the rail clip 64 and/or the stile clip 66 is inserted into the groove 90 of the corner member 82, the lip 72 of the rail clip 64 and/or stile clip 66 engages the projection 92 of the corner member 82. In such instances, the fenestration article 32 disposed between the lip 72 and the projection 92 of the corner member 82.

Figure 16:
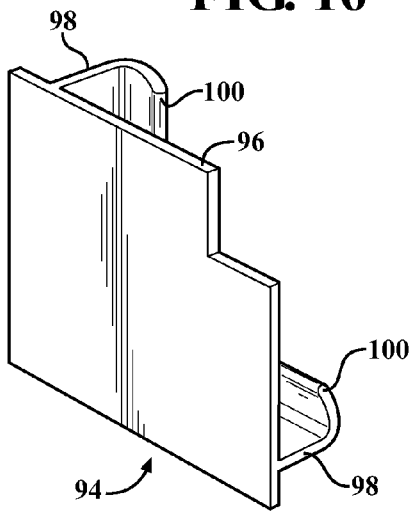
FIG. 16 is a perspective view of the corner clip.
Figure 17:
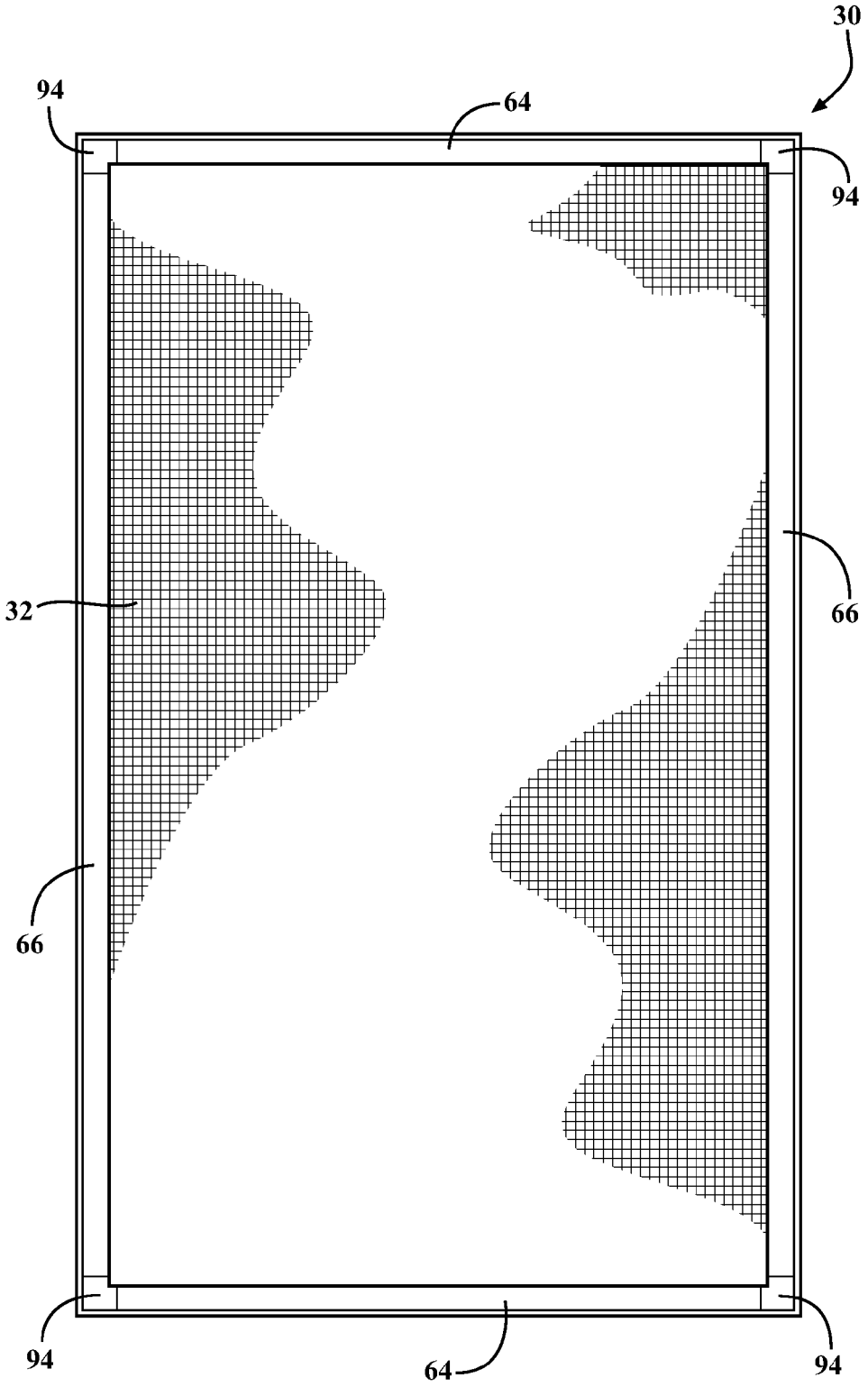
FIG. 17 is another rear view of the adjustable frame assembly according to another embodiment whereby the adjustable frame assembly includes each rail clip abutted between two corner clips and each stile clip abutted between two corner clips.

As shown in FIGS. 16 and 17, the adjustable frame assembly 30 may further include a plurality of corner clips 94. The corner clips 94 generally have a configuration similar to rail clips 64 and/or the stile clips 66. As such, common features between the corner clips 94 and the rail clips 64 and/or the stile clips 66 may be identified by the same descriptive terms. Each corner clip 94 further defines a back wall 96 having a substantially planar configuration and a leg 98 which extends integrally from and substantially perpendicular to the back wall 96 and has substantially planar configuration. A lip 100 having a curved configuration and extends integrally from the leg 98 in a direction towards the back wall 96 of the corner clip 94. Accordingly, the back wall 96, the leg 98, and the lip 100 generally present a J-shaped cross-section for each of the corner clips 94. The corner member 82 and the corner clip 94 may be of any suitable shape, material, color, or texture to give the adjustable frame assembly 30 an aesthetically appealing appearance.

The method may include the step of inserting one of the corner clips 94 into the groove 90 of one of the corner members 82. As illustrated in FIG. 17, the corner clip 94 is typically disposed adjacent to one of the rail clips 64 and one of the stile clips 66 while inserted into the groove 90 of the corner member 82. The corner clip 94 may overlap one of the rail clips 64 and/or one of the stile clips 66. The step of disposing the plurality of rail clips 64 adjacent the plurality of stile clips 66 may be further defined as abutting one of the corner clips 94 between one of the rail clips 64 and one of the stile clips 66. Specifically, in instances where the adjustable frame assembly 30 includes the pair of stile clips 66 and the pair of rail clips 64, as illustrated in FIG. 17, the step of disposing the plurality of rail clips 64 adjacent the plurality of stile clips 66 may be further defined as abutting each rail clip 64 between two corner clips 94 and each stile clip 66 between two corner clips 94.

The method may include the step of inserting one of the corner clips 94 into the groove 90 of one of the corner members 82 to secure the fenestration article 32 between the corner clip 94 and the wall 76 of the corner member 82. Specifically, the method may include the step of disposing the fenestration article 32 between the lip 100 of one of the corner clips 94 and the projection 92 of the wall 76 of one of the corner members 82.

The adhesive 62 may be applied upon the corner member 82, as shown in FIG. 15. The adhesive 62 may secure the fenestration article 32 to the corner member 82 when pressure is applied to the fenestration article 32 against the corner member 82. The fenestration article 32 may be in contact with the adhesive 62 and disposed between the adhesive 62 and the back wall 96 of the corner clip 94. As such, the method may further include the step of securing the fenestration article 32 between the adhesive 62 and the back wall 96 of the corner clip 94.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A method of assembling an adjustable frame assembly for supporting a fenestration article, the adjustable frame assembly including a pair of rail members spaced from each other and a pair of stile members spaced from each other and coupled to the pair of rail members, with each rail member and/or each stile member including sections spaced from each other with at least one adjustment splice interconnecting the sections of each rail member and/or each stile member, and corner members, with each of the rail members and stile members and corner members comprising a wall defining a groove, with a plurality of rail clips configured for insertion into the groove of each rail member and a plurality of stile clips configured for insertion into the groove of each stile member, and a plurality of corner clips configured for insertion into the groove of each corner member, the method comprising the steps of:

inserting the corner members into the pair of rail members and the pair of stile members to interconnect the pair of rail members to the pair of stile members;

sliding the sections of each rail member along at least one of the adjustment splices to adjust a width of the adjustable frame assembly; and/or sliding the sections of each stile member along at least one of the adjustment splices to adjust a height of the adjustable frame assembly;

disposing the fenestration article along the wall and at least partially within the groove of each rail member and each stile member;

inserting the plurality of rail clips into the groove of each rail member to secure the fenestration article between the rail clip and the wall of each rail member;

inserting the plurality of stile clips into the groove of each stile member to secure the fenestration article between the stile clip and the wall of each stile member;

inserting one of the corner clips into the groove of one of the corner members; and disposing the plurality of rail clips adjacent the plurality of stile clips to prevent adjustment of the width and/or height of the adjustable frame assembly resulting from compression forces acting on the adjustable frame assembly.

2. The method of claim 1 wherein the step of disposing the plurality of rail clips adjacent the plurality of stile clips is further defined as abutting together the plurality of rail clips and the plurality of stile clips to prevent adjustment of the width and/or height of the adjustable frame assembly resulting from compression forces acting on the adjustable frame assembly.

3. The method of claim 1 wherein the adjustable frame assembly further comprises an adhesive disposed along the wall of the rail member and/or stile member and said method further comprising the step of applying the fenestration article to the adhesive.

4. The method of claim 1 wherein the adjustable frame assembly further includes a plurality of splice fillers and said method further comprising the step of disposing one of the splice fillers on at least one adjustment splice between the sections of each of the rail members and/or the sections of each of the stile members for filling a gap defined between the sections of each of the rail members and/or the sections of each of the stile members after adjustment of the width and/or height of the adjustable frame assembly.

5. The method of claim 4 further comprising the step of abutting together the splice fillers with the sections of each of the rail members and/or the sections of each of the stile members to prevent adjustment of the width and/or height of the adjustable frame assembly resulting from compression forces acting on the adjustable frame assembly.

6. The method of claim 4 wherein each splice filler includes a wall defining a groove and said method further comprising the step of inserting one of the rail clips and/or one of the stile clips into the groove of one of the splice fillers to secure the fenestration article between the rail clip and/or the stile clip and the wall of the splice filler.

7. The method of claim 1 further comprising the step of inserting one of the rail clips and/or one of the stile clips into the groove of one of the corner members to secure the fenestration article between the rail clip and/or the stile clip and the wall of the corner member.

8. The method of claim 1 wherein the step of disposing the plurality of rail clips adjacent the plurality of stile clips is further defined as abutting one of the corner clips between one of the rail clips and one of the stile clips.

9. The method of claim 1 wherein the adjustable frame assembly includes a pair of rail clips and a pair of stile clips and wherein the step of disposing the plurality of rail clips adjacent the plurality of stile clips is further defined is further defined as abutting each rail clip between two corner clips and abutting each stile clip between two corner clips.

10. The method of claim 1 wherein the adjustable frame assembly includes a pair of rail clips and a pair of stile clips and wherein said step of abutting together the plurality of rail clips and the plurality of stile clips is further defined as abutting each rail clip between the pair of stile clips and each stile clip between the pair of rail clips.

11. The method of claim 1 wherein the steps of sliding the sections of each rail member and/or sliding the sections of each stile member are further defined as sliding the rail sections of each rail member along at least one of the adjustment splices to adjust the width of the adjustable frame assembly and sliding the stile sections of each stile member along at least one of the adjustment splices to adjust the height of the adjustable frame assembly.

12. An adjustable frame assembly comprising:

a pair of rail members spaced from each other with each rail member including a wall defining a groove between a first flange and a second flange of said wall of said rail member;

a pair of stile members spaced from each other with each stile member including a wall defining a groove between a first flange and a second flange of said wall of said stile member;

corner members each interconnecting one of said rail members and one of said stile members and with each corner member including a wall defining a groove;

wherein each of said rail members and/or each of said stile members includes sections spaced from each other with at least one adjustment splice interconnecting sections of each of said rail member and/or each of said stile member, with said sections of each rail member being slidable along at least one of said adjustment splices to adjust a width of said adjustable frame assembly and with said stile sections of each stile member being slidable along at least one of said adjustment splices to adjust a height of said adjustable frame assembly;

a fenestration article disposed along said wall of each of said rail and stile members and at least partially within said groove of each of said rail and stile members;

a plurality of rail clips each including a back wall having a substantially planar configuration and configured for insertion into said groove of one of said rail members to secure said fenestration article to said rail member; and a plurality of stile clips each including a back wall having a substantially planar configuration and configured for insertion into said groove of one of said stile members to secure said fenestration article to said stile member;

a plurality of corner clips each configured for insertion into said groove of one of said corner members to secure said fenestration article to said corner member; and wherein said back wall of said rail clip extends along said first and second flanges of said wall of said rail member and said back wall of said stile clip extends along said first and second flanges of said wall of said stile member.

13. The adjustable frame assembly of claim 12 wherein each of said rail and stile clips includes a leg extending integrally from and substantially perpendicular to said back wall and having a substantially planar configuration with a lip extending integrally from said leg in a direction towards said back wall and having curved configuration.

14. The adjustable frame assembly of claim 12 further including an adhesive disposed along said wall of said rail member and/or said stile member and said fenestration article is in contact with said adhesive and disposed between said adhesive and said back wall of said rail clip and/or said stile clip.

15. The adjustable frame assembly of claim 13 wherein said wall of each of said rail and stile members defines a projection extending into said groove from said wall of each of said rail and stile members.

16. The adjustable frame assembly of claim 15 wherein said fenestration article is disposed between said projection of said wall of said rail member and/or said stile member and said lip of said rail and/or said stile clip.

17. The adjustable frame assembly of claim 13 further including a plurality of splice fillers each configured to be disposed on at least one of said adjustment splices of said rail member and/or said stile member, with each splice filler including a wall defining a groove and having a cross-section substantially corresponding to said wall of said rail member and/or said stile member and with said wall of each splice filler defining a projection extending into said groove from said wall of each splice filler.

18. The adjustable frame assembly of claim 17 wherein said fenestration article is disposed between said lip of one of said rail clip and said stile clips and said projection of said wall of one of said splice fillers.

19. The adjustable frame assembly of claim 12 wherein each corner member includes a projection extending from into said groove from said wall of each corner member.

20. The adjustable frame assembly of claim 19 wherein each of said corner clips further defines a back wall having a substantially planar configuration and a leg extending integrally from and substantially perpendicular to said back wall and having a substantially planar configuration with a lip extending integrally from said leg in a direction towards said back wall and having a curved configuration.

21. The adjustable frame assembly of claim 20 wherein said fenestration article is disposed between said lip of one of said corner clips and said projection of said wall of one of said corner members.

22. The adjustable frame assembly of claim 12 wherein said fenestration article is substantially transparent and configured to reflect ultraviolet light.

23. A method of assembling an adjustable frame assembly for supporting a fenestration article, the adjustable frame assembly including a pair of rail members spaced from each other and a pair of stile members spaced from each other and coupled to the pair of rail members, with each rail member and/or each stile member including sections spaced from each other with at least one adjustment splice interconnecting the sections of each rail member and/or each stile member, and corner members, with each of the rail members and stile members and corner members comprising a wall defining a groove, with a plurality of rail clips configured for insertion into the groove of each rail member and a plurality of stile clips configured for insertion into the groove of each stile member, the method comprising the steps of:

inserting the corner members into the pair of rail members and the pair of stile members to interconnect the pair of rail members to the pair of stile members;

sliding the sections of each rail member along at least one of the adjustment splices to adjust a width of the adjustable frame assembly; and/or sliding the sections of each stile member along at least one of the adjustment splices to adjust a height of the adjustable frame assembly;

disposing the fenestration article along the wall and at least partially within the groove of each rail member and each stile member;

inserting the plurality of rail clips into the groove of each rail member to secure the fenestration article between the rail clip and the wall of each rail member;

inserting the plurality of stile clips into the groove of each stile member to secure the fenestration article between the stile clip and the wall of each stile member;

inserting one of the rail clips and/or one of the stile clips into the groove of one of the corner members to secure the fenestration article between the rail clip and/or the stile clip and the wall of the corner member; and disposing the plurality of rail clips adjacent the plurality of stile clips to prevent adjustment of the width and/or height of the adjustable frame assembly resulting from compression forces acting on the adjustable frame assembly.

24. An adjustable frame assembly comprising:

a pair of rail members spaced from each other with each rail member including a wall defining a groove between a first flange and a second flange of said wall of said rail member;

a pair of stile members spaced from each other with each stile member including a wall defining a groove between a first flange and a second flange of said wall of said stile member;

corner members each interconnecting one of said rail members and one of said stile members and with each corner member including a wall defining a groove;

wherein each of said rail members and/or each of said stile members includes sections spaced from each other with at least one adjustment splice interconnecting sections of each of said rail member and/or each of said stile member, with said sections of each rail member being slidable along at least one of said adjustment splices to adjust a width of said adjustable frame assembly and with said stile sections of each stile member being slidable along at least one of said adjustment splices to adjust a height of said adjustable frame assembly;

a fenestration article disposed along said wall of each of said rail and stile members and at least partially within said groove of each of said rail and stile members;

a plurality of rail clips each including a back wall having a substantially planar configuration and configured for insertion into said groove of one of said rail members to secure said fenestration article to said rail member; and a plurality of stile clips each including a back wall having a substantially planar configuration and configured for insertion into said groove of one of said stile members to secure said fenestration article to said stile member;

wherein one of said rail clips and/or one of said stile clips is configured for insertion into said groove of one of said corner members to secure said fenestration to said corner member; and wherein said back wall of said rail clip extends along said first and second flanges of said wall of said rail member and said back wall of said stile clip extends along said first and second flanges of said wall of said stile member.

* * * * *